US005538013A

United States Patent [19]

Brannon

[11] Patent Number: 5,538,013

[45] Date of Patent: Jul. 23, 1996

[54] MASK HAVING INTERCHANGEABLE SCENTING MEANS

[76] Inventor: Michael A. Brannon, 1072 Pinehurst Blvd., Mt. Morris, Mich. 48458

[21] Appl. No.: 504,041

[22] Filed: Jul. 19, 1995

[51] Int. Cl.[6] ..... A61F 11/00; A61B 19/00

[52] U.S. Cl. ..... 128/857; 128/863; 2/206

[58] Field of Search ..... 128/846, 857, 128/858, 859, 863, 206.24, 202.18; 2/2, 206

[56] References Cited

U.S. PATENT DOCUMENTS

| | | | |
|---|---|---|---|
| 3,438,370 | 4/1969 | Krantz | 128/863 |
| 3,828,577 | 8/1974 | Haynes | 128/204.12 |
| 5,109,839 | 5/1992 | Blasdell | 128/205.25 |
| 5,243,708 | 9/1993 | Vanuch | 128/206.24 |

*Primary Examiner*—Michael A. Brown

*Attorney, Agent, or Firm*—Gifford, Krass, Groh, Sprinkle, Patmore, Anderson & Citkowski

[57] ABSTRACT

A mask placeable over at least one respiratory organ of a user for blocking out unpleasant odors includes an air-permeable body having an inner surface, an outer surface, and a strap for securing the mask in place over the user's face. An air permeable scenting portion is secured to the inner surface of the body and, upon inhalation by the user, scents the otherwise foul smelling air drawn into the mask enclosure. Preferably, a plurality of scenting portions are provided, with each scenting portion representing a different desired scent. According to the several embodiments taught by the invention, the scenting portions are interchangeable to adjust the degree and variety of scent introduced.

11 Claims, 2 Drawing Sheets

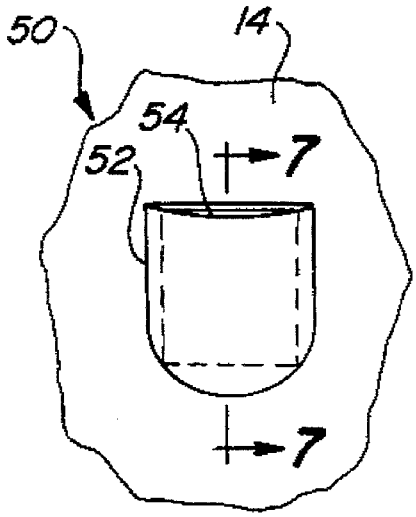
Fig - 6
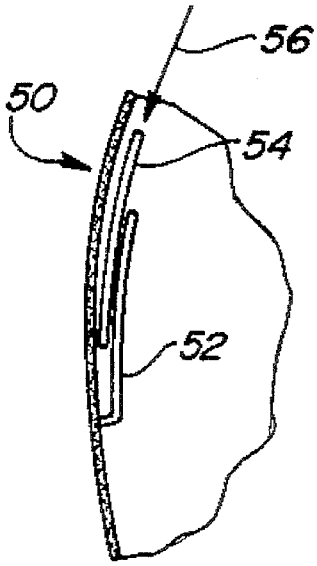
Fig - 7
Fig - 8
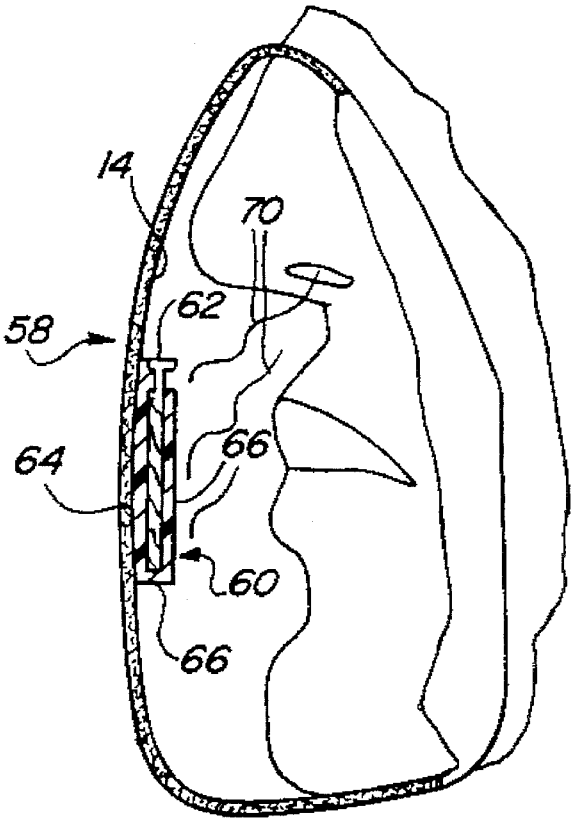
Fig - 9
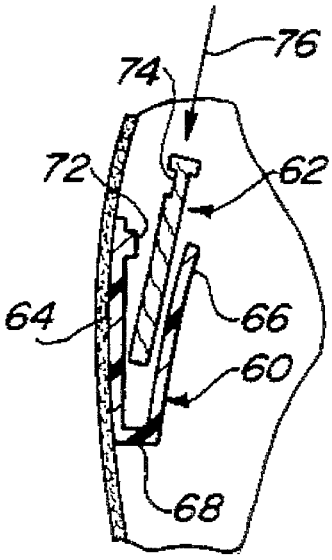

MASK HAVING INTERCHANGEABLE SCENTING MEANS

BACKGROUND OF THE INVENTION

1. Field of the Invention

The present invention relates generally to face mask devices and, more particularly, to a mask device having interchangeable scented cartridges for blocking out unpleasant odors.

2. Description of the prior Art

Various kinds of mask devices and inhalation apparatuses are known in the art, the most common of which being the hospital surgical mask used in the operating room to maintain a sterilized area and to prevent germs from being spread orally. Standard surgical masks are not however suited for blocking out unpleasant odors.

U.S. Pat. No. 5,243,708, issued to Vanuch, teaches a disposable scented mask formed with an outer curvature to extend over and to cover the nose of the wearer. The mask is formed of either a paper or combination paper and cloth material and has a thickened mouthpiece portion permitting it to be gripped by the user's teeth or mouth. A fragrant chemical is applied directly onto the inner surface of the mask by conventional means. The fragrant scenting is most heavily applied to the area surrounding the user's nostrils and less heavily applied to the adjacent areas of the mask. The shortcoming of the Vanuch device is that it is not reusable and that there is no way of adjusting the type and amount of scenting applied to the mask.

U.S. Pat. No. 5,109,839, issued to Blasdell et al., teaches an inhalation apparatus for administering a respiratory gas to a patient which is constructed of a molded elastomer body and has a built-in inhalation valve assembly for covering the patient's mouth or nose. An odorous medium for emitting a selected scent is combined with the thermoplastic material prior to the molding process and the scent flavor is preferably combined with a given color to the mask which is associated with the scent. Blasdell et al. is similar to Vanuch in that scenting of a fixed nature and amount is applied to the body of the covering device and does not teach any interchangeable means for selectively introducing more than one scent.

SUMMARY OF THE PRESENT INVENTION

The present invention is a mask having interchangeable scenting means for blocking out unpleasant odors. The mask includes an air-permeable body shaped to fit over the nose and mouth of a user and a strap extending from opposite sides of the body which secures the body over the user's face. Interchangeable scenting means include a plurality of differently scented portions which are attachable to an inner surface of the body and which provide any one of a plurality of different scents.

In further preferred embodiments, the interchangeable scenting means are provided by pluralities of detachable adhesive portions, insertable pocket portions or scented cartridges which are held within appropriately configured enclosures in the inner surface of the mask body. Tab and slot retaining means may be utilized in the embodiment with the scented cartridge portions and a clip retaining means to prevent the cartridge from accidentally disengaging from within the clip enclosure.

BRIEF DESCRIPTION OF THE DRAWING

Reference will now be made to the attached drawing, when read in combination with the following specification, wherein like reference numerals refer to like parts throughout the several views, and in which:

FIG. 6 is a partial view of a mask showing a pocket shaped enclosure and scented insert portion according to a third preferred embodiment of the present invention;

FIG. 7 is a cutaway taken along line 7—7 of FIG. 6 and showing the manner in which the scented insert is placed within the pocket shaped enclosure according to the third preferred embodiment of the present invention;

FIG. 8 is a side view of a mask incorporating a retaining clip and scented interchangeable cartridge portions according a fourth preferred embodiment of the present invention; and FIG. 9 is a view similar to that shown in FIG. 8 and showing the interchangeable nature of the scented cartridges according to the fourth preferred embodiment.

DESCRIPTION OF THE PREFERRED EMBODIMENTS

Figure 1:
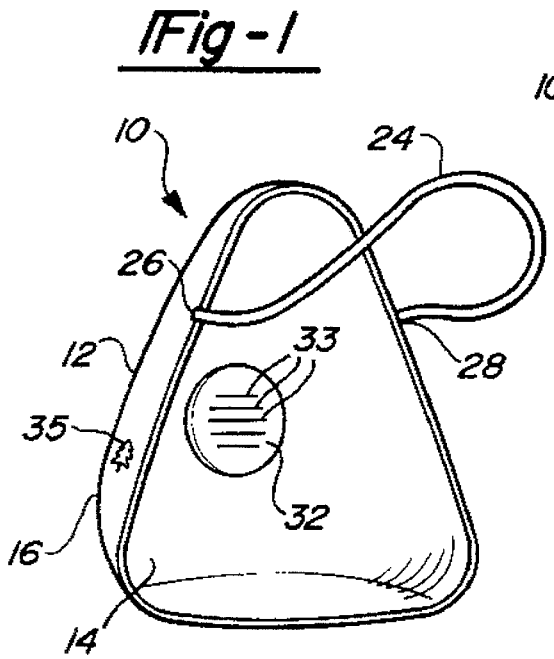
FIG. 1 is a perspective view of a mask having a detachable scenting member according to a first preferred embodiment of the present invention.
Figure 2:
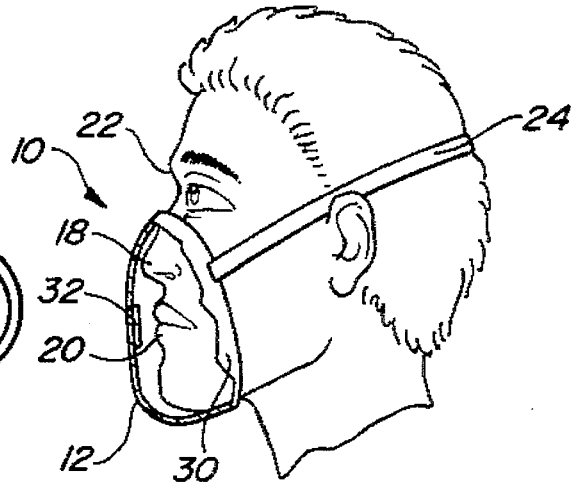
FIG. 2 is a view of the mask shown in FIG. 1 being worn by a user.

Referring to FIGS. 1 and 2, a mask 10 according to a first preferred embodiment of the present invention is shown. The mask 10 is constructed of an air-permeable body 12 such as a foam rubber shell or, alternatively, a porous plastic durable light weight shell and a heavy cotton or polyfiber cover stretched over the shell. The body 12 is bowl shaped and has an inner surface 14 and an outer surface 16 and a general outline which covers at least one respiratory organ of a user. The body 12 shown in FIGS. 1 and 2 is of a generally triangular outline to cover both the nose and mouth but it is also understood that the mask can be shaped in any other desired manner, such as an oval or square, and still fulfill the requirements of the present invention.

Referring to FIG. 2, the mask 10 is shown in place over a nose 18 and a mouth 20 of a user's face 22. The mask 10 could also be shaped so as to cover only the nose 18 since a user's olfactory abilities are mostly limited to that respiratory organ. A strap 24 extends from opposite sides 26 and 28 of the body and engages the user's head to secure the body in place over the user's face. The strap is preferably a continuous elastic band as shown in FIGS. 1 and 2 that can be adjusted to fit the user's face, but could also be a two piece device having a hook and fastener or other conventional securing means (not shown). Referring again to FIG. 2, a lining portion 30 is secured to the inner surface of the body adjacent to the perimeter of its outline such that it contacts the skin of the user's face. The lining portion makes the mask more comfortable to wear and is preferably a cloth or like material which is either sewn or attached by adhesive to the inner surface 14 of the body.

Referring again to FIGS. 1 and 2, an airpermeable scented member 32 is mounted to the inner surface 14 of the mask body in a substantially central location of the body. According to the first preferred embodiment, the scented member 32 is a disk-shaped button portion which is detachably secured in a preferred manner by either a conventional adhesive or VELCRO like securing means (not shown) to the surface 14 of the mask. The scented member 32 may be slotted, at 33, so as to be highly air permeable member and contains a volume of conventional scent generating material for encouraging the generation of a desired scent within the enclosure formed by the mask body.

The scented member is capable of generating any one of a number of distinctive scents within the mask enclosure, such as grape, orange, cherry or watermelon, which acts to block out unpleasant odors which exist on the outside of the mask and which are associated with an unpleasant task to be performed. The mask can also include some form of indicia, such as pine decal 35, to indicate what type of scenting member is being utilized. While only a single scented member 32 is shown in the embodiment of FIGS. 1 and 2, is understood that a plurality of scented members could be provided and that the member 32 could be detached and replaced with another scented member when the amount of scent given off by the member falls below an acceptable value or when it is desirable to insert another scented member. The plurality of additional inserts could be easily provided in a kit or package which comes with the mask assembly (not shown).

Figure 3:
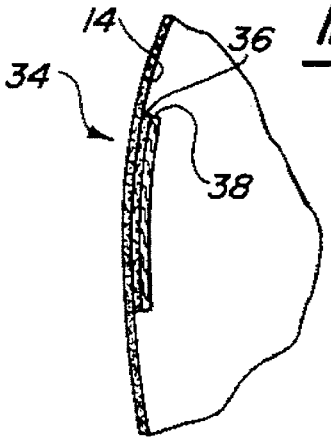
FIG. 3 is a partial side view of a mask with detachable scented portions according to a second preferred embodiment of the present invention.
Figure 4:
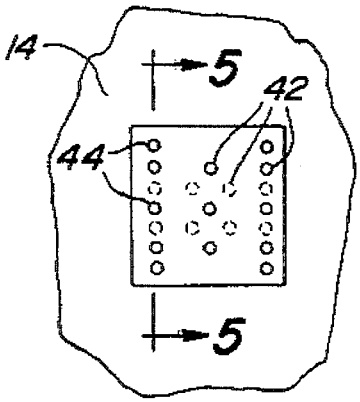
FIG. 4 is a frontal view of the detachable portions shown in FIG. 3 and displaying air flow passages according to the second preferred embodiment of the present invention.
Figure 5:
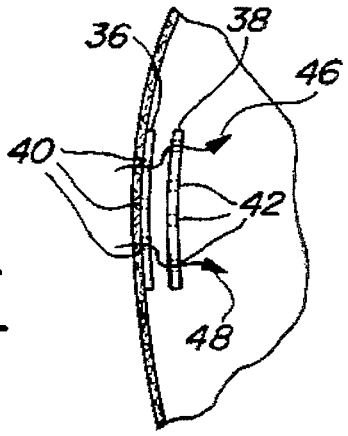
FIG. 5 is a cutaway along line 5—5 of FIG. 4 and showing the detachable and interchangeable nature of the scented portions according to the second preferred embodiment of the present invention.

Referring to FIGS. 3–5, an interchangeable scenting means 34 according to a second preferred embodiment of the present invention is shown and includes a base portion 36 and a scented portion 38 detachably mounted to the base portion 36. The scent producing medium 34 of the second preferred embodiment utilizes an identical mask assembly 10 as shown in the first preferred embodiment and the base portion 36 is secured to the inside surface 14 of the body by a thin layer adhesive or like conventional securing means (not shown). The scented portion 38 is detachably secured to the base portion 36 by adhesive means such as a thin layer adhesive base applied to the surface of the base portion (also not shown). The surfaces of the portions 36 and 38 may also be treated by conventional means to create a small amount of holding force necessary to hold the portion 38 in place.

Referring to FIG. 5, the base portion 36 has a first plurality of apertures 40 formed therethrough at selected locations across the surface of the base portion. The detachable scented portion 38 has a second plurality of apertures 42 formed therethrough at selected locations across the surface of the scented portion and largely offset from the locations of the first plurality of apertures 40. Upon assembly of the base portion and detachable portion, a few of the apertures 40 and 42 from the first and second pluralities overlap (see apertures 44 of FIG. 4), whereas the majority of apertures 42 of the second plurality are offset from the apertures 40 of the first plurality. The effect of the offset apertures is to force air being drawn into the mask, normally during inhalation by the user, to be scented and to be well circulated within the mask (see circulation arrows 46 and 48 of FIG. 5). As is the case with the scented members shown in FIGS. 1 and 2, a plurality of differently scented portions identical to 38 are provided and are interchangeable as desired to adjust the amount and type of scent administered.

Referring to FIGS. 6 and 7, an interchangeable scenting means 50 according to a third preferred embodiment of the present invention is shown and includes an air-permeable pocket shaped enclosure 52 within which is inserted a scented insert portion 54. The pocket shaped enclosure 52 is constructed of either a lightweight air permeable foam or cloth-like material which is sewn or otherwise secured to the inner surface 14 of the mask in a substantially U-shaped manner. The pocket enclosure permits easy insertion and withdrawal of any one of a plurality of inserts identical to the scented insert 54. Although not shown in FIGS. 6 and 7, the pocket shaped enclosure and the insert portion can have pluralities of apertures formed therethrough as shown in the embodiment of FIGS. 3–5 to facilitate the circulation of scented air within the mask. Referring to FIG. 7, the manner in which a scented insert 54 is inserted into the pocket shaped enclosure 52 is shown by arrow 56.

Finally, referring to FIGS. 8 and 9, an interchangeable scenting means used in a mask according to a fourth preferred embodiment 58 of the present is shown and includes an air-permeable retaining clip 60 and scented cartridge portion 62. The retaining clip 60 is secured to the inner surface 14 of the mask body and is constructed of a base member 64 and a deflectable flap portion 66 (see FIG. 9) which is secured to the base member along a common connecting edge portion 68. Both the clip portion and the scented cartridge portion are constructed of any lightweight and air-permeable material which will allow the scent of the cartridge to be circulated within the mask enclosure as shown by scent lines 70 in FIG. 8.

A projecting tab portion 72 is formed along an upper surface of the retaining clip portion 60 and extends inwardly from the base 64 in a direction towards the deflecting flap portion 66. A like configured recess 74 is formed along a surface of the scented cartridge portion 62 facing the tab portion 72 and interlocks with the tab portion upon insertion of the cartridge in a direction shown by arrow 76 in FIG. 9. The tab and slot arrangement of the fourth preferred embodiment prevents accidental disengagement of the scented cartridge from within the retaining clip.

While the specification illustrates a number of different embodiments for applying an interchangeable scent producing medium to the mask, it is understood that there are numerous other possible embodiments for detachably securing interchangeable scented portions according to the present invention. Additional embodiments will become apparent to those skilled in the art to which it pertains upon review of the appended claims.

I claim:

1. A mask placeable over at least one respiratory organ of a user's face for blocking out unpleasant odors, said mask comprising:

an air-permeable body having an inner surface and an outer surface and an outline which is shaped to fit over the respiratory organ of the user;

strap means extending from opposite sides of said body for securing said body over the user's face; and interchangeable scenting means attached to said body for enabling said body to emit any one of a plurality of different scents.

2. The mask as described in claim 1, said interchangeable scenting means further comprising at least one air-permeable scented member which is detachably secured to said inner surface of said airpermeable body.

3. The mask as described in claim 2, said at least one scented member comprising a detachable scented portion and a base portion, said base portion mounting to said inner surface of said body and said detachable scented portion securing over said base portion.

4. The mask as described in claim 3, said base portion having a first plurality of apertures at predetermined locations across said base portion, said detachable scented portion having a second plurality of apertures at predetermined locations across said detachable portion which are largely offset from said first plurality of apertures such that air being drawn through said permeable body and said base and detachable portions is circulated within said mask.

5. The mask as described in claim 3, further comprising a plurality of detachable scented portions which are interchangeably secured to said base portion, each detachable scenting portion of said plurality of portions representing a different scent.

6. The mask as described in claim 1, said interchangeable scenting means further comprising an air permeable pocket-shaped enclosure secured to said inner surface of said air-permeable body, at least one scented insert portion being insertable within an opening of said pocket-shaped enclosure.

7. The mask as described in claim 6, further comprising a plurality of scented insert portions which are interchangeably insertable within said pocket-shaped enclosure.

8. The mask as described in claim 1, said interchangeable scenting means further comprising an air permeable retaining clip, said retaining clip including a base secured to said inner surface of said body and a flap portion connected to said base along a common edge, said flap portion being deflected outwardly to permit the insertion of a scented cartridge portion within a recess in said retaining clip.

9. The mask as described in claim 8, further comprising a projecting tab on said retaining clip base, a recessed slot in said scented cartridge portion aligning with said tab to prevent said cartridge portion from being accidentally disengaged.

10. The mask as described in claim 9, said scented cartridge portion further comprising a plurality of differently scented cartridge portions.

11. The mask as described in claim 10, further comprising a lining portion which is secured to said body around said outline of said body in abutting contact with the user's face.

* * * * *